US010957260B2

(12) United States Patent
Kuei et al.

(10) Patent No.: US 10,957,260 B2
(45) Date of Patent: Mar. 23, 2021

(54) METHOD OF CONTROLLING POWER LEVEL OF OUTPUT DRIVER IN SOURCE DRIVER AND SOURCE DRIVER USING THE SAME

(71) Applicant: NOVATEK Microelectronics Corp., Hsin-Chu (TW)

(72) Inventors: Cheng-Kai Kuei, Hsinchu (TW); Chin-Hung Hsu, Taoyuan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 74 days.

(21) Appl. No.: 15/657,203

(22) Filed: Jul. 23, 2017

(65) Prior Publication Data

US 2018/0374427 A1 Dec. 27, 2018

Related U.S. Application Data

(63) Continuation-in-part of application No. 15/633,732, filed on Jun. 26, 2017.

(51) Int. Cl.

| | |
|---|---|
| ***G09G 3/34*** | (2006.01) |
| ***G09G 3/22*** | (2006.01) |
| ***G09G 3/36*** | (2006.01) |

(52) U.S. Cl.

CPC ..... *G09G 3/34* (2013.01); *G09G 3/22* (2013.01); *G09G 3/3688* (2013.01); *G09G 2310/027* (2013.01); *G09G 2310/0289* (2013.01); *G09G 2310/0291* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 2004/0036670 | A1* | 2/2004 | Chung | G09G 3/3688 345/99 |
| 2012/0026152 | A1* | 2/2012 | Chung | G09G 3/3688 345/212 |
| 2013/0021306 | A1 | 1/2013 | Kuo | |
| 2014/0168187 | A1 | 6/2014 | Qu | |
| 2014/0253535 | A1 | 9/2014 | Lim | |
| 2016/0104428 | A1* | 4/2016 | In | G09G 3/3275 345/214 |
| 2018/0158408 | A1* | 6/2018 | Chae | G09G 3/3233 |

FOREIGN PATENT DOCUMENTS

KR 1020160165868 * 12/2016 ..... G09G 2310/0264

* cited by examiner

*Primary Examiner* — Ifedayo B Iluyomade

(74) *Attorney, Agent, or Firm* — Winston Hsu

(57) ABSTRACT

A source driver of a display system includes a plurality of channels, and each of the plurality of channels includes a first latch, a second latch, an output driver and a comparator. The first latch receives a first data code and a second data code from a timing controller of the display system. The second latch receives the first data code from the first latch. The output driver is used for transmitting the first data code to a display panel of the display system. The comparator, coupled to the first latch, the second latch and the output driver, is used for comparing the first data code stored in the second latch with the second data code stored in the first latch, to generate a signal indicating a power level for the output driver to transmit the second data code.

8 Claims, 9 Drawing Sheets

METHOD OF CONTROLLING POWER LEVEL OF OUTPUT DRIVER IN SOURCE DRIVER AND SOURCE DRIVER USING THE SAME

CROSS REFERENCE TO RELATED APPLICATIONS

This application is a continuation-in-part application of U.S. application Ser. No. 15/633,732, filed on Jun. 26, 2017, the contents of which are incorporated herein by reference.

BACKGROUND OF THE INVENTION

1. Field of the Invention

The present invention relates to a method used in a display system, and more particularly, to a method of controlling the power level of an output driver in a source driver of a display system.

2. Description of the Prior Art

A display driver integrated circuit (IC) is a circuit used for driving a display panel. The display driver IC transmits signals or data to each row and column of pixels on the display panel, to drive the pixels of the display panel to display an image. For example, a thin-film transistor liquid crystal display (TFT LCD) is driven by a gate driver IC and a source driver IC. The gate driver IC is coupled to the gate terminal of the TFTs on the display panel, for turning the TFTs on or off. The source driver IC, which is coupled to the source terminal of the TFTs, transmits display data to the TFTs when the TFTs are turned on. The TFTs are turned on by the gate driver IC line by line, so the display data transmitted to the turned-on TFTs are called line data, which are received by a line of TFTs at a time.

In general, the gate driver IC and the source driver IC are controlled by a timing controller. The timing controller transmits line data to the source driver IC, which then forwards the line data to the display panel. Please refer to FIG. 1, which is a schematic diagram of a conventional source driver 10, which includes latches L1 and L2, a level shifter 102, a digital to analog converter (DAC) 104 and an operational amplifier (OP) 106. The line data may be transmitted to the latch L1 from the timing controller, and then go through the latch L2, the level shifter 102, the DAC 104 and the operational amplifier 106. The operational amplifier 106 then outputs the line data to the display panel, to generate the gray scale voltage on the source terminal of the TFTs.

In general, the operational amplifier 106 outputs the line data with a predetermined power level or slew rate, such that the operational amplifier 106 may output the line data with a fixed driving capability, and thereby drive the display panel to change the gray scale voltage in every data cycle. However, since the difference between two consecutive gray scale voltages on the same node may be different in different data cycles, different driving capabilities of the operational amplifier 106 are required. Thus, there is a need for improvement over the prior art.

SUMMARY OF THE INVENTION

It is therefore an objective of the present invention to provide a method of controlling the power level of an output driver in a source driver of a display system, allowing the output driver to output the line data with adequate power level and driving capability.

An embodiment of the present invention discloses a source driver of a display system. The source driver comprises a plurality of channels, and each of the plurality of channels comprises a first latch, a second latch, an output driver and a comparator. The first latch receives a first data code and a second data code from a timing controller of the display system. The second latch receives the first data code from the first latch. The output driver is used for transmitting the first data code to a display panel of the display system. The comparator, coupled to the first latch, the second latch and the output driver, is used for comparing the first data code stored in the second latch with the second data code stored in the first latch, to generate a signal indicating a power level for the output driver to transmit the second data code.

An embodiment of the present invention further discloses a method of controlling a power level of an output driver used for a source driver of a display system. The method comprises receiving a first data code and a second data code from a timing controller of the display system; and comparing the first data code with the second data code, to generate a signal indicating the power level for the output driver to transmit the second data code to a display panel of the display system.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
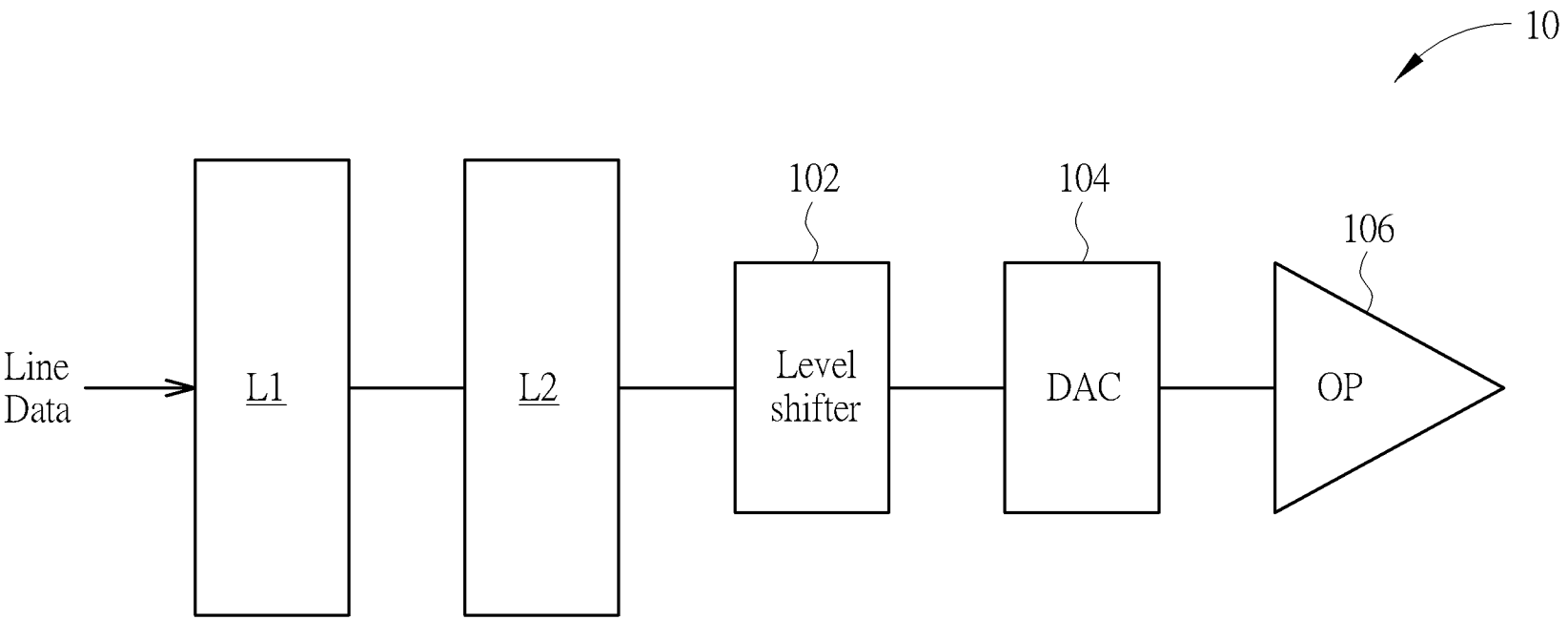
FIG. 1 PRIOR ART
FIG. 1 is a schematic diagram of a conventional source driver.
Figure 2:
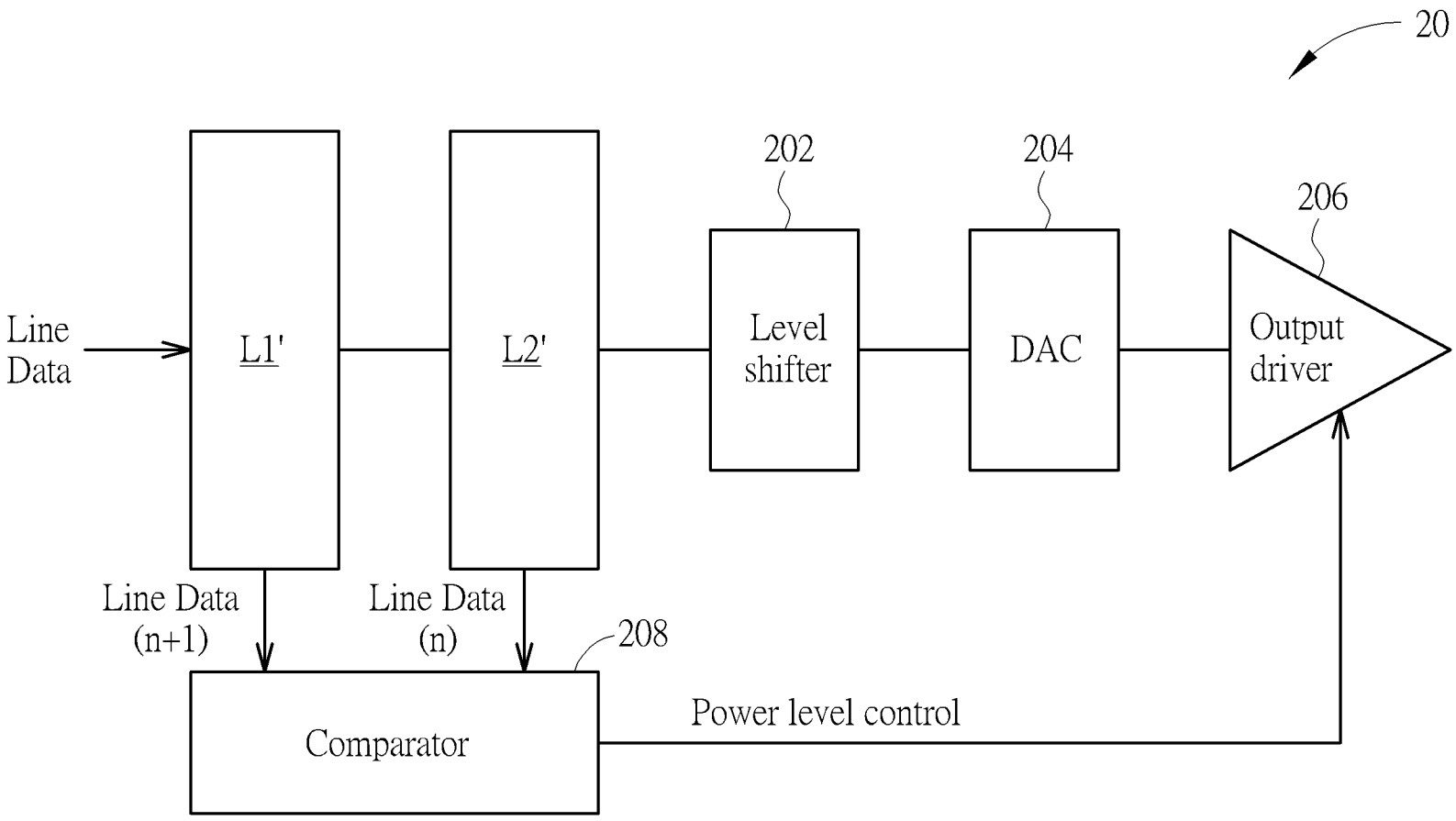
FIG. 2 is a schematic diagram of a source driver according to an embodiment of the present invention.

Please refer to FIG. 2, which is a schematic diagram of a source driver 20 according to an embodiment of the present invention. As shown in FIG. 2, the source driver 20 includes latches L1' and L2', a level shifter 202, a digital to analog converter (DAC) 204, an output driver 206 and a comparator 208. Similarly, the line data is transmitted through the latch L1', the latch L2', the level shifter 202, the DAC 204 and the output driver 206, and then outputted to a display panel of the display system by the output driver 206. Note that each of the modules illustrated in FIG. 2 refers to a set of modules in a plurality of channels of the source driver 20. For example, the source driver 20 may include multiple channels, where each channel includes two latches, a level shifter, a DAC and an output driver with the structure shown in FIG. 2. Different from the structure of the source driver 10 shown in FIG. 1, the source driver 20 further includes the comparator 208. The comparator 208 may compare line data n+1 stored in the latch L' with line data n stored in the latch L2', and thereby generate a signal indicating a power level for the output driver 206 to transmit the line data n+1.

In a data cycle, the output driver 206 outputs a line data to the display panel. The line data includes a plurality of data codes for a line of pixels on the display panel. Each data code is outputted via an output driver in a channel. The output driver 206 may be realized with an operational amplifier, a buffer, or other circuits capable of driving the source node of the thin-film transistor (TFT) on the display panel to reach the gray scale voltage according to the received data code.

Figure 3:
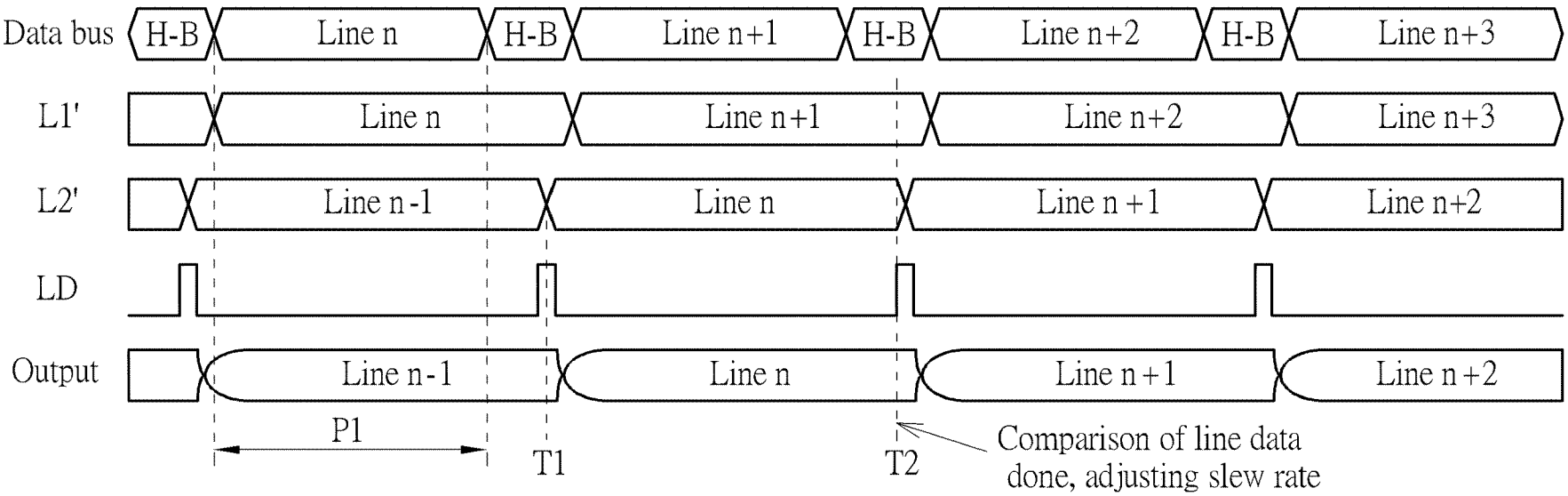
FIG. 3 is a waveform diagram of timings of line data in a source driver.

Please refer to FIG. 3, which is a waveform diagram of timings of line data in a source driver such as the source driver 20, where waveforms of the line data on the data bus and the latches L1' and L2', the LD signal, and the line data outputted by the output driver 206 are illustrated. The source driver 20 receives line data n to line data n+3 in sequence from the timing controller via the data bus, with a horizontal blanking (H-B) signal between every two consecutive line data. Take reception of the line data n as an example. During the period P1, the data codes of the line data n are serially transmitted to the latch L1' in each channel, where each latch L1' in a channel receives a corresponding data code among the line data n. At the time T1 where every data code of the line data n is already received by and stored in the latch L1', the load (LD) signal triggers and the line data n is transmitted to the latch L2' at the same time according to the LD signal. Subsequently, at the falling edge of the LD signal, the output driver 206 starts to output the line data n stored in the latch L2'. In the similar manner, the follow-up line data n+1, n+2 . . . are transmitted to the latches L1' and L2' in sequence and then outputted by the output driver 206.

Therefore, when the line data n is stored in the latch L2', the latch L1' is serially receiving the line data n+1; hence, the comparator 208 may compare the line data n+1 stored in the latch L1' with the line data n stored in the latch L2'. At the time T2 where the line data n+1 is completely received by the latch L1' and the comparison of the line data n and the line data n+1 is done, the comparator 208 may generate a signal indicating the power level for the output driver 206 to transmit the line data n+1. More specifically, the comparator 208 may transmit the signal to the output driver 206, to control the output driver 206 to adjust a slew rate for transmitting the line data n+1. At the falling edge of this LD signal, the output driver 206 can thereby transmit the line data n+1 with the specific power level.

Please note that the data codes in each channel may be compared at the same time, e.g., at the time T2 where all data codes of the line data n+1 are received by the latch L1'. Alternatively, the data codes in each channel may be compared separately. Since the data codes of a line data is received by the latch L1' in sequence, the comparison time of different channels may be different if the comparison in a channel is performed right after the corresponding data code is received by the latch L1' in the channel. In fact, the comparison of a specific data code stored in the latch L1' with the corresponding data code stored in the latch L2' may be performed at any time after the specific data code is received by the latch L1'.

Figure 4:
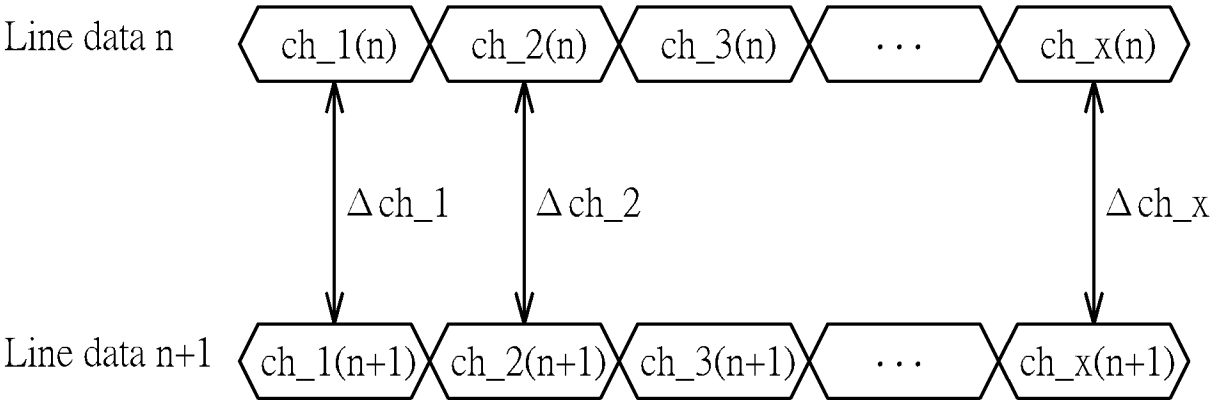
FIG. 4 is a schematic diagram of comparison between two consecutive line data.

In detail, the source driver 20 may include a plurality of channels, and the comparison of line data is performed for each channel. Please refer to FIG. 4, which is a schematic diagram of comparison between two consecutive line data. As shown in FIG. 4, the source driver 20 includes x channels ch_1-ch_x, where the line data n and n+1 are compared in each channel ch_1-ch_x. The line data n includes a plurality of data codes ch_1(*n*)-ch_x(n), and each data code ch_1(*n*)-ch_x(n) is transmitted via a corresponding channel among the channels ch_1-ch_x. The line data n+1 includes a plurality of data codes ch_1(*n*+1)-ch_x(n+1), and each data code ch_1(*n*+1)-ch_x(n+1) is transmitted via a corresponding channel among the channels ch_1-ch_x. The comparator 208 may compare the data code of the line data n with the corresponding data code of the line data n+1 in each channel. For example, the data code ch_1(*n*) is compared with the data code ch_1(*n*+1) in the channel ch_1, and a difference value Δch_1 is generated according to the difference between the data code ch_1(*n*) and the data code ch_1(*n*+1). Therefore, the slew rate or power level of the output driver 206 in the channel ch_1 may be adjusted or controlled according to the difference value Δch_1, so that the output driver 206 may output the data code ch_1(*n*+1) with an adequate driving capability.

In the similar manner, the slew rate or power level of the output driver 206 in the channel ch_2-ch_x may be adjusted or controlled according to the corresponding difference value Δch_2-Δch_x. The detailed operations in each channel are similar, and will not be narrated herein. In such a situation, the comparator 208 may refer to a set of comparators, and each of the comparators is used for comparing data codes in one of the channels ch_1-ch_x. Alternatively, the comparator 208 may be a single comparator used for the comparison in all of the channels ch_1-ch_x.

Figure 5:
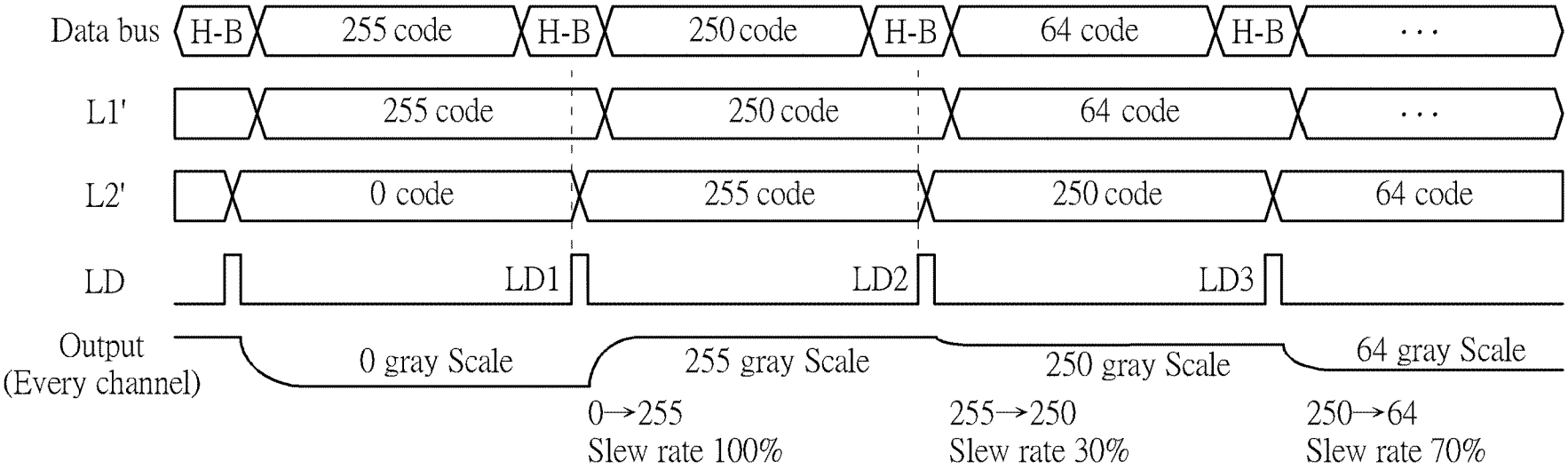
FIG. 5 illustrates an exemplary embodiment of data comparison via the comparator.

FIG. 5 illustrates an exemplary embodiment of data comparison via the comparator 208. As shown in FIG. 5, the latch L1' in each channel receives data codes 255, 250 and 64 in sequence, and the latch L2' correspondingly receives data codes 255, 250 and 64 after a data code 0. Note that the data codes 0-255 refer to the gray scale to be displayed in a corresponding pixel of the panel. The difference between two consecutive gray scales may indicate the driving capability required in the output driver 206, and thereby the slew rate of the output driver 206 may be controlled accordingly. For example, when the LD signal LD1 triggers, the comparison result indicates that the difference values of the data codes stored in the latches L1' and L2' in every channel are equal to 255 since the data codes change from 0 to 255; hence, the power level of the output driver 206 may be adjusted to a maximum value, where the output driver 206 may output the line data with 100% slew rate to change the gray scale of the target pixels. When the LD signal LD2 triggers, the comparison result indicates that the difference values of the data codes stored in the latches L1' and L2' in every channel are equal to 5 since the data codes change from 255 to 250; hence, the power level of the output driver 206 may be adjusted to a smaller value, where the output driver 206 may output the line data with 30% slew rate to change the gray scale of the target pixels. When the LD signal LD3 triggers, the comparison result indicates that the difference values of the data codes stored in the latches L1' and L2' in every channel are equal to 186 since the data codes change from 250 to 64; hence, the power level of the output driver 206 may be adjusted to a moderate value, where the output driver 206 may output the line data with 70% slew rate to change the gray scale of the target pixels.

Figure 6:
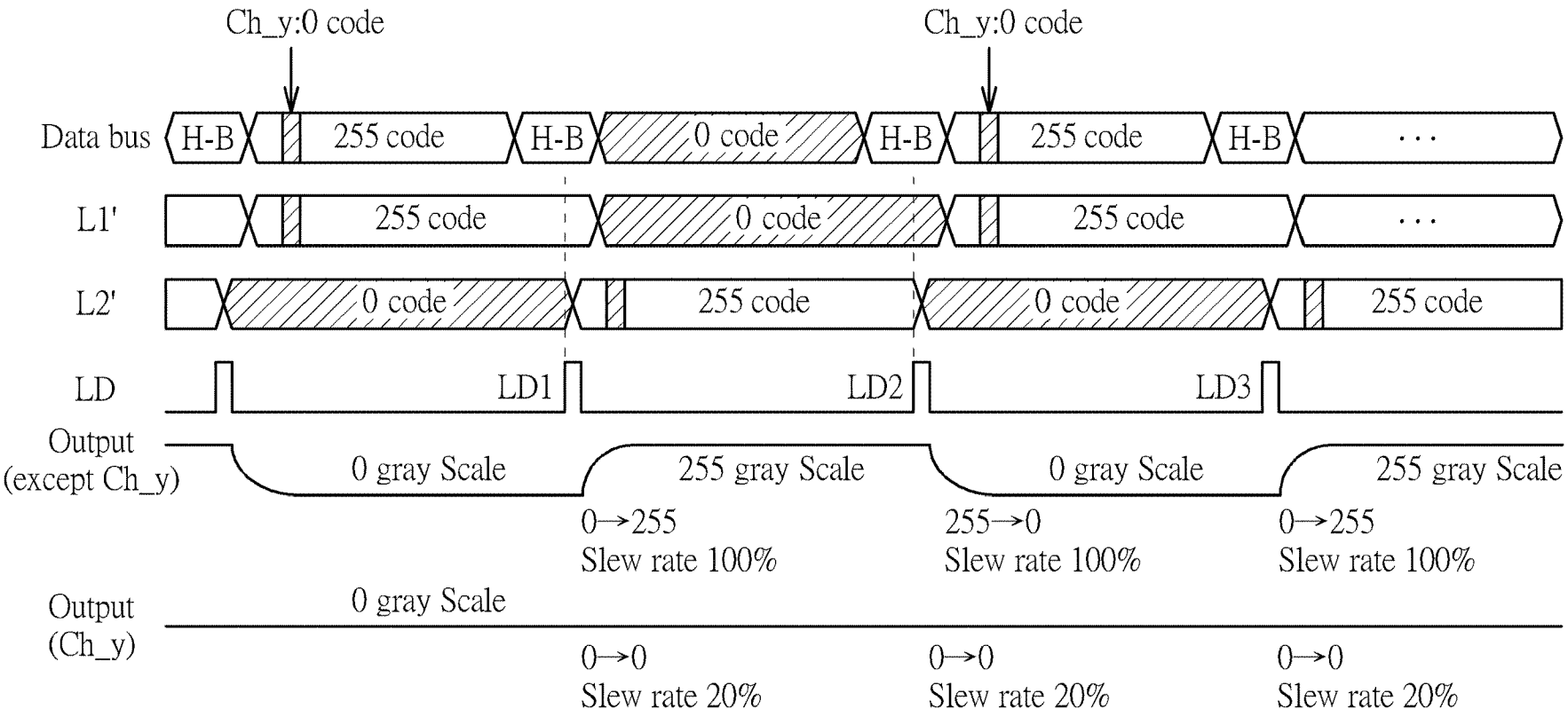
FIG. 6 illustrates another exemplary embodiment of data comparison with different values of data codes between different channels.

FIG. 6 illustrates another exemplary embodiment of data comparison with different values of data codes between different channels. As shown in FIG. 6, the latch L1' in a channel ch_y receives data codes 0, 0 and 0 in sequence, while the latch L1' in other channels receives data codes 255, 0 and 255 in sequence. These data codes are then transmitted to the latch L2' in the corresponding channel, respectively. When the LD signal LD1 triggers, the comparison result indicates that the difference values of the data codes stored in the latches L1' and L2' inmost channels except the channel ch_y are equal to 255 since the data codes change from 0 to 255; hence, the power level of the output driver 206 in most channels except the channel ch_y may be adjusted to a maximum value, where the output driver 206 may output these data codes with 100% slew rate to change the gray scale of the target pixels. In comparison, the difference value of the data codes stored in the latches L1' and L2' in the channel ch_y is equal to 0 since the data code changes from 0 to 0; hence, the power level of the output driver 206 in the channel ch_y may be adjusted to a minimum value, where the output driver 206 may output the data code with 20% slew rate to change the gray scale of the target pixel. Similarly, when the LD signals LD2 and LD3 trigger, the power level of the output driver 206 in most channels except the channel ch_y is adjusted to the maximum value (i.e., 100% slew rate), while the power level of the output driver 206 in the channel ch_y is adjusted to the minimum value (i.e., 20% slew rate) according to the comparison results obtained from the comparator 208.

In the above embodiments, the power level of the output driver 206 in each channel is independently controlled according to a comparison result for the channel. In such a situation, different output drivers in different channels may have different power levels since the data codes received in different channels may be different such as the case shown in FIG. 6. In another embodiment, the power level of the output driver 206 in all channels may be controlled together according to a comparison result generated by comparing the data code stored in the latch L1' with the data code stored in the latch L2' in all channels. In such a situation, the output driver 206 in all of the channels may be controlled to have the same power level and output the data code with an identical slew rate. This control method is simpler and has the benefit of lower circuit complexity and fewer costs.

More specifically, the power level of the output driver 206 in all of the plurality of channels is adjusted to a value determined by using the signal generated from the comparator 208 detecting that the first data code and the second data code have a maximum difference value among the plurality of channels. For example, a source driver may include three channels, and the difference values obtained from comparison of data codes in these three channels are 20, 40 and 60 at the same data cycle. The difference value 60, which is the maximum among the three channels, is adopted to determine the power level and slew rate of the output driver 206 in all channels in this data cycle. Please note that the implementations of determining the power level of the output driver 206 in all channels should not be limited thereto, and alternatively, the power level of the output driver 206 in all channels may be determined according to an average of the difference values of data codes determined from all or several channels.

Figure 7:
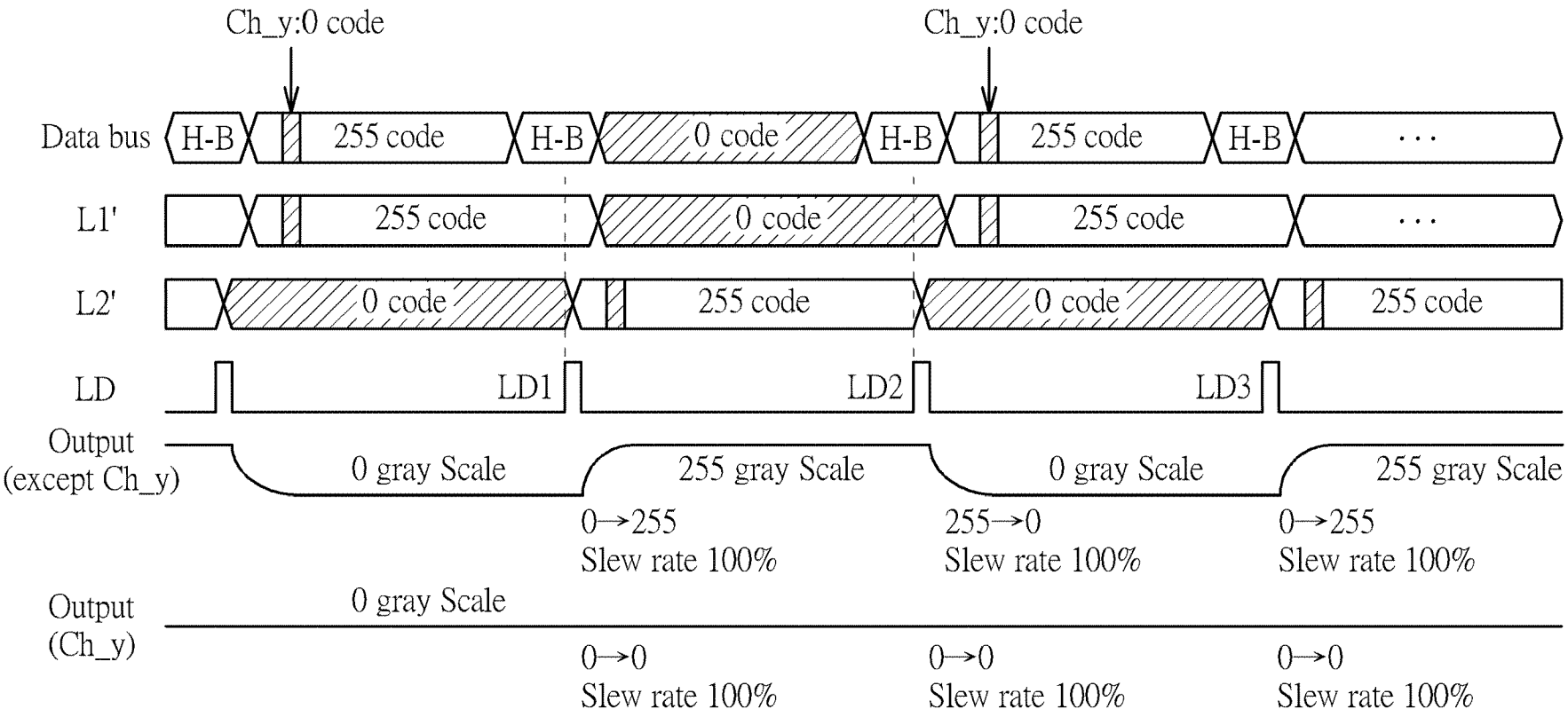
FIG. 7 illustrates an exemplary embodiment of data comparison where the power level of the output driver in every channel is controlled to have the same value.

FIG. 7 illustrates an exemplary embodiment of data comparison where the power level of the output driver 206 in every channel is controlled to have the same value. The data codes received by the source driver in this embodiment are identical to the embodiment shown in FIG. 6. That is, the latches L1' and L2' in the channel ch_y receive data codes 0, 0 and 0 in sequence, while the latches L1' and L2' in other channels receive data codes 255, 0 and 255 in sequence. When the LD signal LD1 triggers, the comparison result indicates that the difference values of the data codes stored in the latches L1' and L2' in most channels except the channel ch_y are equal to 255 since the data codes change from 0 to 255, while the difference value of the data codes stored in the latches L1' and L2' in the channel ch_y is equal to 0. The power level of the output driver 206 in all channels may be adjusted to a maximum value since the maximum difference value obtained among the channels is 255. Therefore, the output driver 206 may output the data codes with 100% slew rate in all channels including the channel ch_y, to change the gray scale of the target pixels. Similarly, when the LD signals LD2 and LD3 trigger, the power level of the output driver 206 in all channels is adjusted to the maximum value (i.e., 100% slew rate) according to the maximum difference value indicated from the comparison results.

In an embodiment, the power level of the output driver 206 may be adjusted to increase or decrease according to the difference value between the data code stored in the latch L1' and the data code stored in the latch L2'. For example, when the comparator 208 determines that the difference value between the data codes is greater than an upper threshold, the power level of the output driver 206 may be increased. When the comparator 208 determines that the difference value between the data codes is less than a lower threshold, the power level of the output driver 206 may be decreased. When the comparator 208 determines that the difference value between the data codes is between the upper threshold and the lower threshold, the power level of the output driver 206 may not change.

Figure 8:
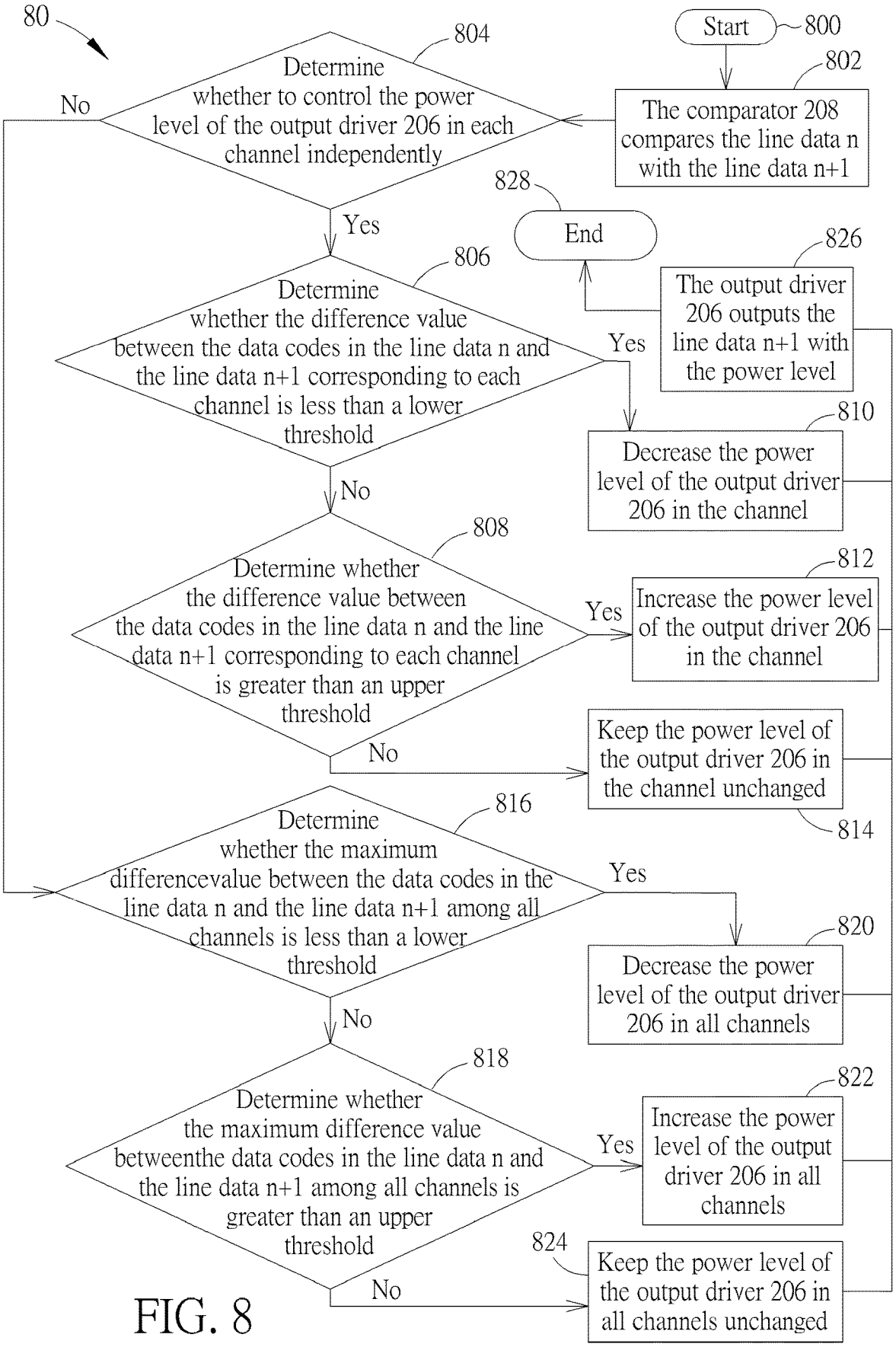
FIG. 8 is a flow chart of a power level control process according to an embodiment of the present invention.

Please refer to FIG. 8, which is a flow chart of a power level control process 80 according to an embodiment of the present invention. The power level control process 80, which may be realized in a source driver such as the source driver 20 shown in FIG. 2, includes the following steps:

Step 800: Start.

Step 802: The comparator 208 compares the line data n with the line data n+1.

Step 804: Determine whether to control the power level of the output driver 206 in each channel independently. If yes, go to Step 806; otherwise, go to Step 816.

Step 806: Determine whether the difference value between the data codes in the line data n and the line data n+1 corresponding to each channel is less than a lower threshold. If yes, go to Step 810; otherwise, go to Step 808.

Step 808: Determine whether the difference value between the data codes in the line data n and the line data n+1 corresponding to each channel is greater than an upper threshold. If yes, go to Step 812; otherwise, go to Step 814.

Step 810: Decrease the power level of the output driver 206 in the channel. Then go to Step 826.

Step 812: Increase the power level of the output driver 206 in the channel. Then go to Step 826.

Step 814: Keep the power level of the output driver 206 in the channel unchanged. Then go to Step 826.

Step 816: Determine whether the maximum difference value between the data codes in the line data n and the line data n+1 among all channels is less than a lower threshold. If yes, go to Step 820; otherwise, go to Step 818.

Step 818: Determine whether the maximum difference value between the data codes in the line data n and the line data n+1 among all channels is greater than an upper threshold. If yes, go to Step 822; otherwise, go to Step 824.

Step 820: Decrease the power level of the output driver 206 in all channels. Then go to Step 826.

Step 822: Increase the power level of the output driver 206 in all channels. Then go to Step 826.

Step 824: Keep the power level of the output driver 206 in all channels unchanged. Then go to Step 826.

Step 826: The output driver 206 outputs the line data n+1 with the power level.

Step 828: End.

Please note that the power level control process 80 is one of various embodiments of the present invention, and those skilled in the art may readily make modifications. For example, in another embodiment, the comparison with the upper threshold may be performed before the comparison with the lower threshold. In addition, the power level may change by increasing or decreasing one fixed step at one time. Alternatively, if the difference value is far greater or less than the difference value in the previous data cycle, the power level may be increased or decreased by more steps at one time.

According to embodiments of the present invention, the output driver may be operated in an adequate power level and may output the line data with an adequate driving capability or slew rate. This prevents the problem of wasting power if the power level is set too high, or the problem that the driving capability is not enough to drive the gray scale voltage to the target level in time.

Figure 9:
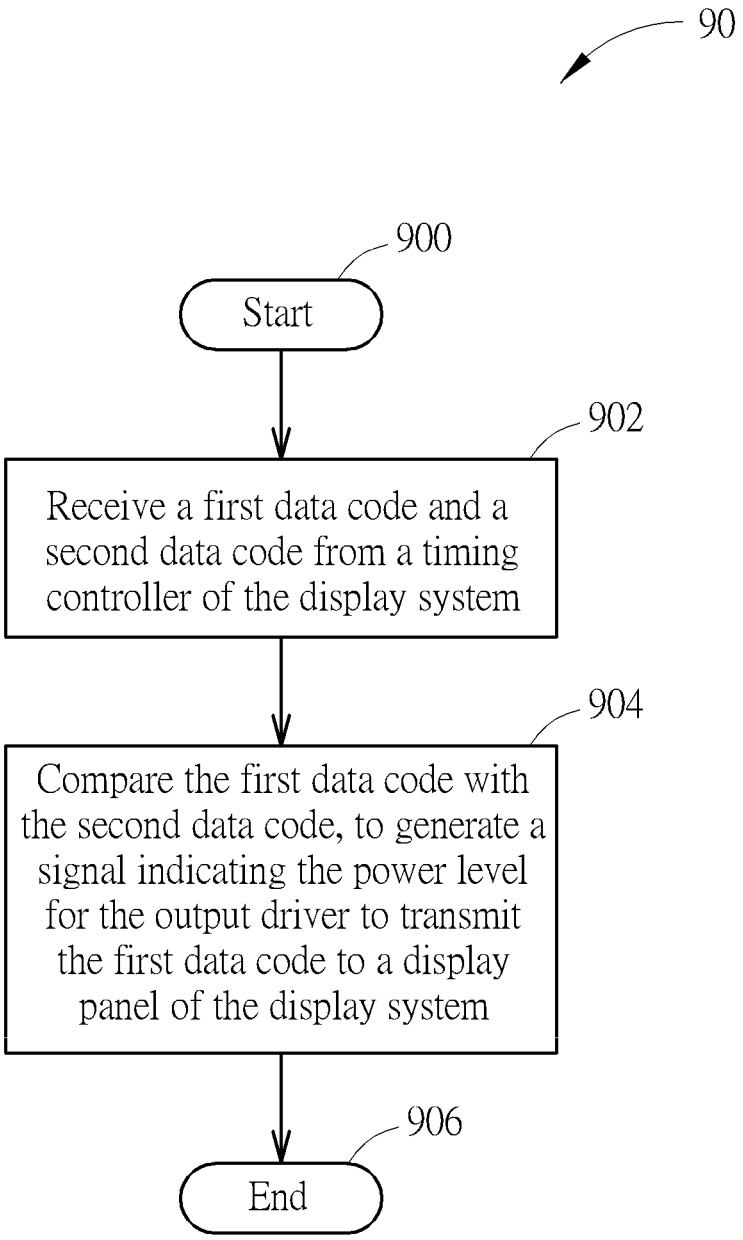
FIG. 9 is a flow chart of a process according to an embodiment of the present invention.

The abovementioned operations of controlling the power level of the output driver may be summarized into a process 90, as shown in FIG. 9. The process 90, which may be realized in a source driver of a display system such as the source driver 20 shown in FIG. 2, includes the following steps:

Step 900: Start.

Step 902: Receive a first data code and a second data code from a timing controller of the display system.

Step 904: Compare the first data code with the second data code, to generate a signal indicating the power level for the output driver to transmit the first data code to a display panel of the display system.

Step 906: End.

The detailed implementations and variations of the process 90 are illustrated in the above paragraphs, and will not be narrated herein.

To sum up, the present invention provides a method of controlling a power level of the output driver in the source driver of the display system. The source driver includes a comparator, which compares two consecutive line data. The difference value between the data codes in two consecutive line data may therefore be obtained and then used for determining the power level of the output driver. In such a situation, the output driver may output the line data with adequate power level and driving capability.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A source driver of a display system, the source driver comprising a plurality of channels, each of the plurality of channels comprising:

a first latch, for receiving a first data code and a second data code from a timing controller of the display system;

a second latch, for receiving the first data code from the first latch;

an output driver, for transmitting the first data code to a display panel of the display system; and a comparator, coupled to the first latch, the second latch and the output driver, for comparing the first data code stored in the second latch with the second data code stored in the first latch, to generate a difference value of the first data code and the second data code, wherein a signal generated by the comparator controls the output driver to adjust a slew rate, allowing the output driver to transmit the second data code with a driving capability corresponding to the slew rate without changing an output voltage of the output driver corresponding to the second data code;

wherein the source driver is configured to determine a maximum difference value among the difference values obtained in the plurality of channels, and the slew rate of the output driver in all of the plurality of channels is adjusted to a level determined based on the maximum difference value.

2. The source driver of claim 1, wherein the slew rate of the output driver is increased when the comparator determines that a difference value between the first data code and the second data code is greater than a threshold.

3. The source driver of claim 1, wherein the slew rate of the output driver is decreased when the comparator determines that a difference value between the first data code and the second data code is less than a threshold.

4. The source driver of claim 1, wherein the slew rate of the output driver in each of the plurality of channels is independently controlled according to a comparison result for the channel.

5. A method of controlling a slew rate of an output driver used for a source driver of a display system, the source driver comprising a plurality of channels, the method comprising:

as for each of the plurality of channels, receiving a first data code and a second data code from a timing controller of the display system;

storing the second data code in a first latch of the source driver and storing the first data code in a second latch of the source driver; and comparing the first data code stored in the second latch with the second data code stored in the first latch, to generate a difference value of the first data code and the second data code, wherein a signal is generated to control the output driver to adjust the slew rate, allowing the output driver to transmit the second data code with a driving capability corresponding to the slew rate without changing an output voltage of the output driver corresponding to the second data code; and determining a maximum difference value among the difference values obtained in the plurality of channels, and adjusting the slew rate of the output driver in all of the plurality of channels to a level determined based on the maximum difference value.

6. The method of claim 5, wherein the slew rate of the output driver is increased when a difference value between the first data code and the second data code is determined to be greater than a threshold.

7. The method of claim 5, wherein the slew rate of the output driver is decreased when a difference value between the first data code and the second data code is determined to be less than a threshold.

8. The method of claim 5, wherein the source driver comprises a plurality of channels, each of which comprises an output driver, and the method further comprises:

independently controlling the slew rate of the output driver in each of the plurality of channels according to a comparison result for the channel.

* * * * *